US009808732B2

(12) United States Patent
Bruder

(10) Patent No.: US 9,808,732 B2
(45) Date of Patent: Nov. 7, 2017

(54) COUPLING

(71) Applicant: Bruder Spielwaren GmbH + Co. KG, Fürth (DE)

(72) Inventor: Paul Heinz Bruder, Fürth (DE)

(73) Assignee: BRUDER SPIELWAREN GMBH & CO. KG, Fuerth (DE)

( * ) Notice: Subject to any disclaimer, the term of this patent is extended or adjusted under 35 U.S.C. 154(b) by 683 days.

(21) Appl. No.: 13/749,173

(22) Filed: Jan. 24, 2013

(65) Prior Publication Data

US 2013/0196568 A1 Aug. 1, 2013

(51) Int. Cl.

| | |
|---|---|
| ***A63H 33/08*** | (2006.01) |
| ***A63H 33/04*** | (2006.01) |
| ***A63H 17/26*** | (2006.01) |
| ***A63H 19/18*** | (2006.01) |
| ***A63H 33/06*** | (2006.01) |

(52) U.S. Cl.

CPC ..... *A63H 33/04* (2013.01); *A63H 17/264* (2013.01); *A63H 19/18* (2013.01); *A63H 33/062* (2013.01)

(58) Field of Classification Search

CPC ..... A63H 33/04; A63H 17/264; A63H 19/18; A63H 33/062

USPC ..... 446/120, 124, 127; 24/265 H

See application file for complete search history.

(56) References Cited

U.S. PATENT DOCUMENTS

| | | | | |
|---|---|---|---|---|
| 1,021,271 | A * | 3/1912 | Sharp | 59/95 |
| 1,464,161 | A * | 8/1923 | Wirkkala | 294/74 |
| 1,666,272 | A * | 4/1928 | Spiering | 403/353 |
| 1,786,081 | A * | 12/1930 | Nourse | 403/165 |
| 3,287,028 | A * | 11/1966 | Dorge | 280/495 |
| 3,504,937 | A * | 4/1970 | Panovic | 403/164 |
| 4,072,320 | A * | 2/1978 | Powell | 280/416.1 |
| 4,723,804 | A * | 2/1988 | Gatens | 294/82.11 |
| 5,461,820 | A * | 10/1995 | Sorola | 43/43.1 |
| 7,736,214 | B2 * | 6/2010 | Brumagin et al. | 446/376 |

* cited by examiner

*Primary Examiner* — Vishu Mendiratta

(74) *Attorney, Agent, or Firm* — McGlew and Tuttle, P.C.

(57) ABSTRACT

A coupling for connecting a first coupling part to one toy component and a second coupling part connected to another toy component. The two coupling parts are connected to one another along a connecting axis to be rotated relative to one another thereabout. One of the coupling parts is a receiving coupling part having a locking guide receiving portion, which has a locking receiver extending in the peripheral direction about the connecting axis through more than 180°. The other coupling part is an insert coupling part having at least two insert guide portions axially spaced apart from one another along the connecting axis and guided radially in the receiving coupling part. A first insert guide portion is received to lock in the locking guide receiving portion of the receiving coupling part. A second insert guide portion is guided in a second guide receiving portion of the receiving coupling part.

20 Claims, 3 Drawing Sheets

COUPLING

CROSS-REFERENCES TO RELATED APPLICATIONS

This application claims the priority of German Patent Application, Serial No. 10 2012 201 132.2, filed Jan. 26, 2012, pursuant to 35 U.S.C. 119(a)-(d), the content of which is incorporated herein by reference in its entirety as if fully set forth herein.

FIELD OF THE INVENTION

The invention relates to a coupling for connecting two toy components. Furthermore, the invention is directed at a toy with at least one corresponding coupling.

BACKGROUND OF THE INVENTION

Toys with couplings are generally known from public prior use. Couplings are particularly frequently used in toy vehicles. Couplings are particularly frequently found in use in cranes, loaders, trailers or tractors. The couplings are used here to temporarily connect two toy components, such as, for example, crane booms and crane hooks, between toy vehicles and trailers or between toy locomotives and wagons. A relatively large amount of manual skill is generally required to connect or release the coupling parts of known couplings. Moreover, a large expenditure of force, which is often not possible, in particular for children, is necessary to connect or release the coupling parts. Furthermore, it is generally not possible in known couplings of toy components to rotate the coupling parts relative to one another in the connected assembly position.

U.S. Pat. No. 1,021,271 A discloses a swivel.

SUMMARY OF THE INVENTION

The invention is based on the object of providing a coupling, which eliminates the drawbacks mentioned. Above all, a coupling that is easy to assemble and to release is to be provided. A corresponding toy with at least one coupling of this type is also to be provided.

These objects are achieved according to the invention by a coupling for connecting two toy components with a. a first coupling part, which can be connected to one of the two toy components, b. with a second coupling part, which can be connected to the other of the two toy components, c. wherein the two coupling parts are connected to one another along a connecting axis and can be rotated relative to one another about this connecting axis, d. wherein one of the coupling parts is configured as a receiving coupling part and has at least one locking guide receiving portion, which has a locking receiver extending in the peripheral direction about the connecting axis through more than 180°, e. wherein the other of the coupling parts is configured as an insert coupling part and has at least two insert guide portions, which are axial spaced apart from one another along the connecting axis and guided radially in the receiving coupling part, f. wherein a first insert guide portion is simultaneously a counter-locking portion, which is received so as to lock in the locking guide receiving portion of the receiving coupling part, g. wherein a second insert guide portion is provided, which is guided in a second guide receiving portion of the receiving coupling part, and by a toy with a coupling according to the invention, in which the toy is a crane or a toy vehicle, for example a loader, logging skidder, logging trailer, forest tractor.

The core of the invention is to provide a coupling to connect two toy components with a first coupling part, which can be connected to one of the two toy components, and a second coupling part, which can be connected to the other of the two components, the two coupling parts being connected to one another along a connecting axis and being rotatable relative to one another about this connecting axis. One of the coupling parts is configured as a receiving coupling part and has at least one locking guide receiving portion or snap-on guide receiving portion, which has a locking receiver or a snap-on receiver extending in the peripheral direction about the connecting axis through more than 180°. The other coupling part is configured as an insert coupling part and comprises at least two insert guide portions, which are axially spaced apart from one another along the connecting axis and are guided radially in the receiving coupling part, one of the insert guide portions simultaneously being a counter-locking portion or counter-snap-on portion, which is received to lock in or to snap in the locking guide receiving portion of the receiving coupling part. A second insert guide portion is guided in a second guide receiving portion of the receiving coupling part. Two toy components can be connected to one another by the coupling by means of a locking connection or snap-on connection without a great expenditure of force and can likewise be separated again.

The configuration, in which the second insert guide portion has an insert guide groove, which is guided by the second guide receiving portion in the form of a counter-collar, provides that the second insert guide portion has an insert guide groove, the insert guide groove being guided by the second guide receiving portion.

The insert guide groove is preferably configured as a peripheral groove. This configuration leads to an extremely functionally reliable connection between the first coupling part and the second coupling part. To guide the insert guide groove, the second guide receiving portion preferably has a counter-collar, which extends over a part region of an inner periphery of the second guide receiving portion. An axial and radial guidance of the insert coupling part in the receiving coupling part is provided by the groove-counter-collar connection.

Preferably, at least one of the two coupling parts is connected in one piece to the associated toy component. The respective coupling part and the associated toy component are preferably configured as a one-piece injection molded component. Toy components may, for example, be configured as a crane hook, a crane shovel, a connecting piece to a crane shovel or a crane hook, or a wood loading gripper. Owing to the one-piece configuration, the required toy components are reduced, which simplifies the assembly of the individual elements of the coupling.

Preferably, one of the insert guide portions is radially guided in the locking guide receiving portion. An undesired tilting movement of the insert coupling part relative to the receiving coupling part is prevented by this advantageous configuration.

Preferably, the locking guide receiving portion is configured as a part connecting sleeve, the locking receiver having an insert window extending in the peripheral direction about the connecting axis through less than 180°. The insert window is used to insert the insert coupling part in the receiving coupling part. The insert window, in this case, has a height extent, which extends along the connecting axis. The height extent of the insert window, in an assembly position of the coupling, preferably predetermines the maximum axial movement of the insert coupling part along the connecting axis in the receiving coupling part.

An expedient configuration provides that at least one of the insert guide portions is configured as an annular collar around a profile portion of the insert coupling part. At least the first insert guide portion, which cooperates with the locking guide receiving portion, is preferably configured as an annular collar. The annular collar has a thickness or height extent, which extends along the connecting axis. The annular collar is advantageously axially guided in the insert window and, for this reason, has a thickness, which is less than the height of the insert window.

An advantageous provides that at least one of the insert guide portions is guided axially in the receiving coupling part. This configuration prevents the coupling parts inadvertently moving relative to one another in the axial direction.

Preferably, one of the insert guide portions is axially guided in the locking guide receiving portion, one of the insert guide portions having a peripheral groove for this purpose. The peripheral groove is preferably located in the assembly position in the region of the locking receiver of the locking guide receiving portion. The peripheral groove provides a particularly easily configured safety mechanism against an inadvertent axial movement of the insert coupling part along the connecting axis in the receiving coupling part.

Preferably, the receiving coupling part comprises a first abutment stop to insert the insert coupling part in the receiving coupling part by overcoming the locking force. The necessary force expenditure for inserting the insert coupling part in the receiving coupling part is significantly reduced by the first abutment stop.

Preferably, it is provided that the receiving coupling part has a second abutment stop to release the insert coupling part from the receiving coupling part by overcoming the locking force. Owing to the configuration with the second abutment stop, the required expenditure of force to release the coupling is significantly reduced.

Preferably, it is possible to insert and release the insert coupling part by tilting the insert coupling part relative to the receiving coupling part about a tilting axis 45 perpendicular to the connecting axis. A counter-window may be provided in the receiving coupling part to facilitate the insertion. Owing to the provision of a counter-window, the assembly of the coupling parts is further simplified. The simple connection and release of the coupling parts is above all significant because the coupling, as a component of a toy, is primarily used by children.

The toy may, for example, be a crane or any toy vehicle, such as a loader, logging skidder, logging trailer or forest tractor. Children and/or adults can play with the toy. However, it may also only be a miniature model.

A preferred embodiment of the invention will be described by way of example below with reference to the accompanying drawings.

DESCRIPTION OF THE PREFERRED EMBODIMENT

Figure 2:
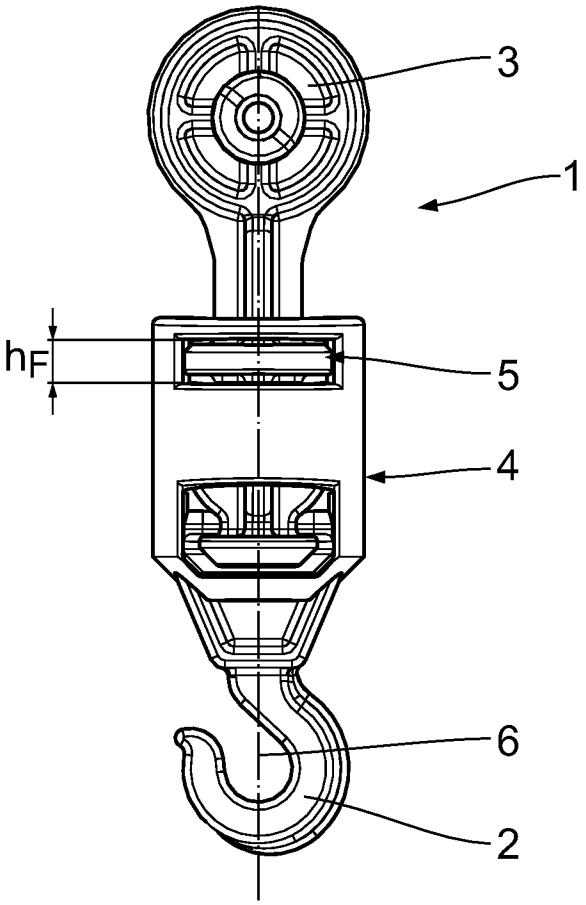
FIG. 2 shows a view of the coupling according to FIG. 1 in a view rotated through 180°.

Corresponding parts are provided in FIG. 1 to FIG. 6 with the same reference numerals. Details of the embodiments described in more detail below may also be an invention on their own or be part of an inventive idea.

Figure 1:
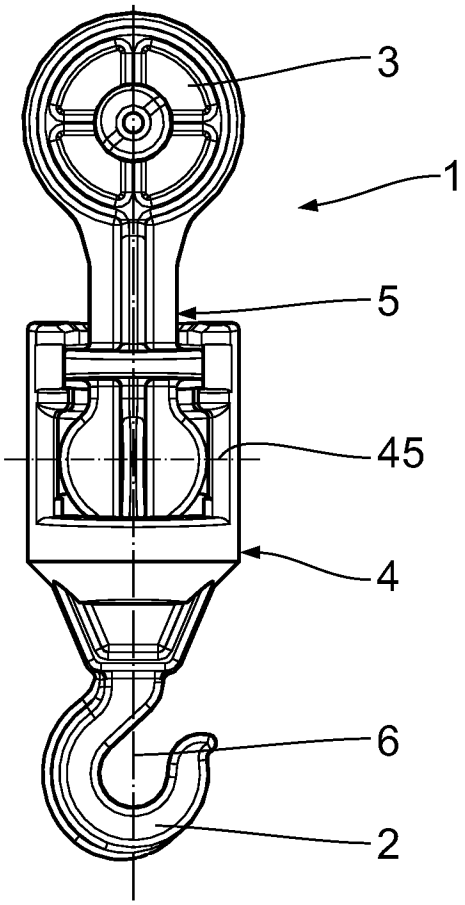
FIG. 1 shows a view from the front of a coupling according to the preferred embodiment, comprising a receiving coupling part and an insert coupling part.

The expressions "inside", "outside", "top" or the like relate to the intended arrangement of the coupling as shown in FIG. 1.

An embodiment of a coupling 1 for connecting two toy components 2, 3 is shown in FIG. 1. As can be inferred, for example, from FIG. 1, the first toy component 2 is a crane hook. The second toy component 3 is a connecting piece, for example to fasten the crane hook in a crane boom of a toy crane.

The coupling 1 comprises a first coupling part 4, which is configured in one piece with the first toy component, and a second coupling part 5, which is configured in one piece with the second toy component. The first coupling part 4 is configured as a receiving coupling part and the second coupling part 5 is configured as an insert coupling part.

Alternatively it is also possible for the coupling parts 4, 5 to be configured as separate components and to not be connected in one piece with the respective toy components. For this alternative case, locking or screw connections would be suitable, for example, to connect the coupling parts 4, 5 to the toy components 2, 3.

In an assembled assembly position shown in FIG. 1 and FIG. 2, the receiving coupling part 4 and the insert coupling part 5 are connected to one another along a connecting axis 6 and can be rotated relative to one another about the connecting axis 6. In the preferred embodiment variant, the receiving coupling part 4 and the insert coupling part 5 can be rotated relative to one another through 360°. In this case, a rotational direction is possible both in the clockwise direction as also in the anticlockwise direction.

Figure 4:
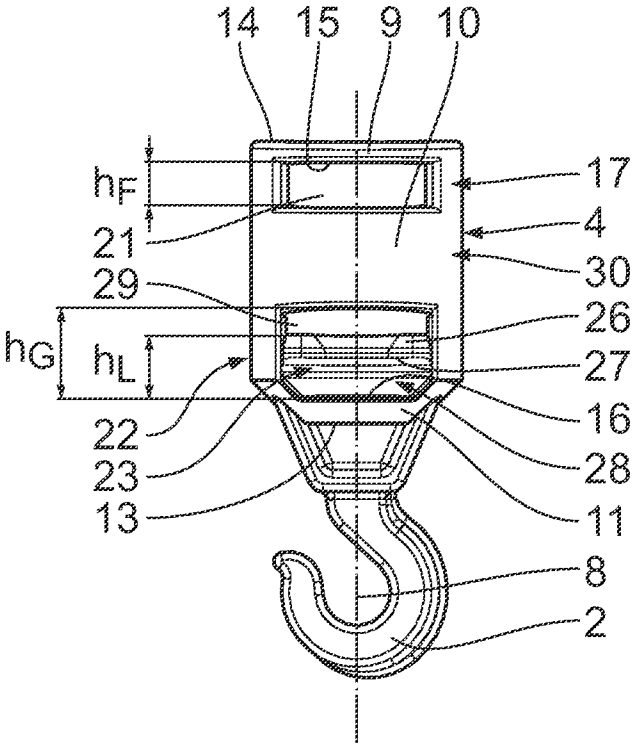
FIG. 4 shows a view of the receiving coupling part according to FIG. 3 in a view rotated through 180°.
Figure 3:
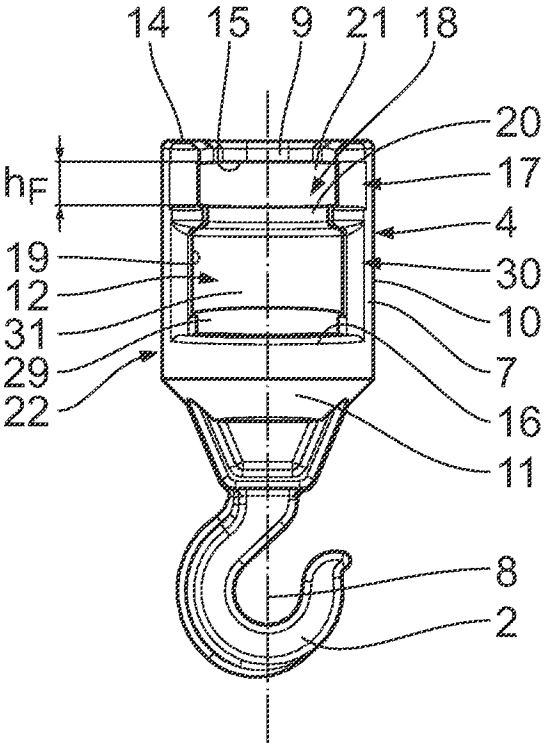
FIG. 3 shows a view of the receiving coupling part according to FIGS. 1 and 2 in isolation from the front.
Figure 6:
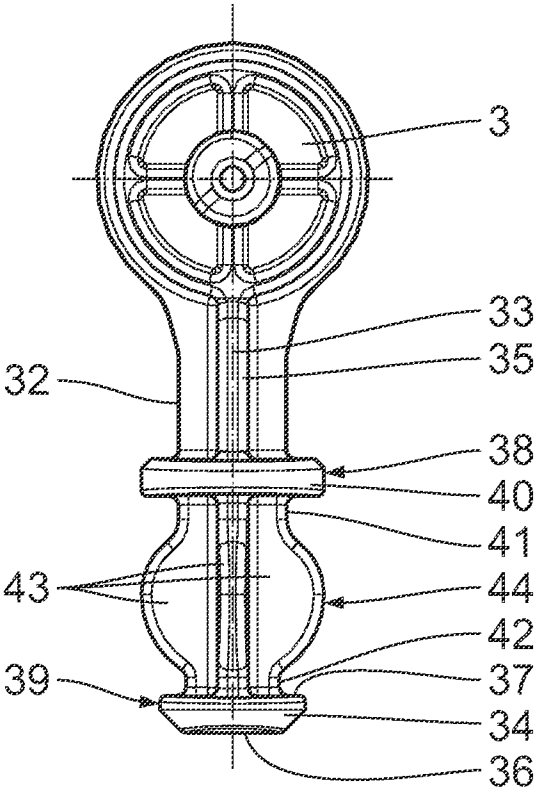
FIG. 6 shows a view of an insert coupling part according to FIGS. 1 and 2 in isolation in a view from the front.

The receiving coupling part 4 shown in a released disassembly position in FIG. 3 and FIG. 4 comprises an elongate base body 7 made of a suitable plastics material. The base body 7 of the receiving coupling part 4 substantially has a semi-cylindrical sleeve shape with a longitudinal extent along a centre longitudinal axis 8. In the assembly position, the centre longitudinal axis 8 is preferably congruent with the connecting axis 6.

The base body 7 of the receiving coupling part 4 comprises an end wall 9, which is adjacent in the assembly position to the second toy component 3, an outer wall 10 extending partially about the centre longitudinal axis 8 in the peripheral direction and a second end wall 11 facing the first toy component 2.

The end walls 9, 11 run parallel to one another and extend perpendicular to the centre longitudinal axis 8. The spacing of the two end walls 9, 11 along the centre longitudinal axis 8 predetermines a receiving region 12 within the outer wall 10 to receive the insert coupling part 5.

In the embodiment shown, the end wall 11 is connected in one piece, at its outer side 13 remote from the end wall 9, to the first toy component 2. The end wall 11 is circular, viewed in cross-section. The end wall 9, on the other hand, has a sickle-shaped or c-shaped form in cross-section.

The first end wall 9 comprises an end wall outer side 14 pointing in the direction 2 of the toy component 3 in the assembly position and an end wall inner side 15 facing the receiving region 12. The end wall inner side 15 of the first end wall 9 runs parallel to an end wall inner side 16 of the second end wall 11 and perpendicular to the centre longitudinal axis 8.

Adjoining the end wall inner side 15 of the first end wall 9, the receiving coupling part 4 has a first guide receiving portion 17, which is configured as a locking guide receiving portion. The locking guide receiving portion 17 comprises a locking receiver 18 extending about the centre longitudinal axis 8 in the peripheral direction.

The locking receiver 18 is configured as a part connecting sleeve and forms the free, upper part of the base body 7. The locking receiver 18 is used to lock in a portion of the insert coupling part 5 and preferably extends through more than 180° in the peripheral direction about the centre longitudinal axis 8 or, in the assembly position of the coupling 1, about the connecting axis 6. It is particularly advantageous if the locking receiver 18 extends between 190° and 230° about the centre longitudinal axis 8.

The locking receiver 18 comprises a locking collar 20, which projects from an inner face 19 of the base body 7, extends in the peripheral direction about the centre longitudinal axis 8 on the inner face 19 and runs parallel and spaced apart with respect to the end wall 9. The locking collar 20 has a thickness with an extent along the centre longitudinal axis 8. The extent of the locking collar 20 away from the inner face 19 in the direction of the centre longitudinal axis 8 is significantly less than a radius of the base body 7.

The locking receiver 18, between the peripheral locking collar 20 and the first end wall 9, has an insert window 21 extending in the peripheral direction about the centre longitudinal axis 8 through less than 180° to interact with the insert coupling part 5. The insert window 21 preferably extends between 90° and 120° in the base body 7 in the peripheral direction about the centre longitudinal axis 8. The insert window 21 has a height $h_F$, which corresponds to the spacing between the locking collar 20 and the first end wall 9.

Adjacent to the end wall inner side 16 of the second end wall 11, the receiving coupling part 4 has a second guide receiving portion 22.

The second guide receiving portion 22 comprises a bearing receiver 23, which extends in the peripheral direction about the centre longitudinal axis 8 through more than 180° and forms the lower part of the base body 7, which, in the assembly position, is located adjacent to the first toy component 2.

Figure 5:
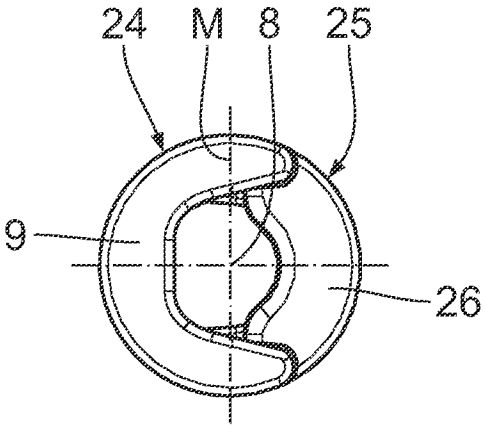
FIG. 5 shows a view of the receiving coupling part according to FIG. 3 and FIG. 4 in a view from above.

The bearing receiver 23 is arranged opposing the locking receiver 18 of the first guide receiving portion 17 with respect to a centre plane going through the centre longitudinal axis 8. The centre plane M is illustrated in FIG. 5. The centre plane M divides the base body 7 into two cylinder halves or part sleeves 24, 25, the first guide receiving portion 17 extending over the entire periphery of the first cylinder half 24 and the second guide receiving portion 22 extending in regions over the periphery of the second cylinder half 25. The bearing receiver 23 has a height $h_L$, which extends along the centre longitudinal axis 8 away from the second end wall 11. The height $h_L$ of the bearing receiver 23 preferably corresponds to less than 25% of a total height of the receiving coupling part 4 from the end wall 11 to the end wall 9.

The bearing receiver 23 is terminated toward the top by a bearing receiver end wall 26. The bearing receiver end wall 26 is configured as a peripheral counter-collar projecting radially in the direction of the centre longitudinal axis 8. The counter-collar 26 runs spaced apart and parallel with respect to the first end wall 9 and the second end wall 11. The extent of the counter-collar 26 in the direction of the centre longitudinal axis 8 is less than the radius of the base body 7. The counter-collar 26 preferably extends in the peripheral direction through about 180° about the centre longitudinal axis 8. The counter-collar 26 has a counter-collar lower side 27 pointing in the direction of the end wall 11, a bearing receiving region 28 to receive a portion of the insert coupling part 5 being formed between the counter-collar lower side 27 and the end wall inner side 16 of the second end wall 11.

Opposing the bearing receiving region 28 with respect to the centre plane M, there is provided in the base body 7 a counter-window 29, by means of which the insertion of the insert coupling part 5 into the receiving coupling part 4 is facilitated. The counter-window 29 extends at a height $h_G$ along the centre longitudinal axis 8 from the end wall inner side 16 of the second end wall 11 in the direction of the first end wall 9. As is to be inferred, in particular from FIG. 4, the height $h_G$ of the counter-window 29 is preferably greater than the height $h_L$ of the bearing receiver 23. The counter-window 29 preferably extends in the peripheral direction about the centre longitudinal axis 9 through less than 180°. The extent of the counter-window 29 in the peripheral direction about the centre longitudinal axis 8, in the preferred embodiment variant, corresponds to the extent in the peripheral direction of the insert window 21 about the centre longitudinal axis 8. The counter-window 29 and the insert window 21 are in each case arranged in the first cylinder half 24 of the base body 7.

A third guide receiving portion 30, which is used as a stop guide receiving portion, extends between the counter-window 29 and the insert window 21. The third guide receiving portion 30, in accordance with the locking receiver 18, extends through more than 180° in the peripheral direction about the centre longitudinal axis 8 and has a stop guide inner face 31 for the abutment of a portion of the insert coupling part 5.

The second coupling part 5 configured as an insert coupling part comprises an elongate body 32 made of a suitable plastics material with an x-shaped profile, viewed in cross section, the largest geometrical dimension of which (=length) extends along a centre longitudinal axis 33.

The receiving coupling part 4 and the insert coupling part 5 are preferably injection-molded from an identical plastics material. These are produced in corresponding moulds.

The centre longitudinal axis 33 of the insert coupling part 5, in the assembly position shown in FIG. 1 and FIG. 2, is congruent with the centre longitudinal axis 8 of the receiving coupling part 4 and the connecting axis 6. The base body 32 of the insert coupling part 5 comprises a first, cross-sectionally circular end wall 34. The end 35 of the insert coupling part 5 remote from the end wall 34 is connected in one piece to the second toy component 3. The circular end wall 34, the centre point of which rests on the centre longitudinal axis 33, has an end wall outer side 36 facing the second end wall inner side 16 of the receiving coupling part 4 in the assembly position and an end wall inner side 37 facing the end 35 of the insert coupling part 5.

The insert coupling part 5 comprises two insert guide portions 38, 39, which are axially spaced apart from one another with respect to the centre longitudinal axis 33 and are guided radially and axially in the receiving coupling part 4.

The first insert guide portion 38 is arranged adjacent to the end 35 of the insert coupling part 5 and simultaneously forms a counter locking portion, which is received, in the assembly position, to lock in the locking guide receiving portion 17 of the receiving coupling part 4. The second insert guide portion 39 is preferably guided in the second guide receiving portion 22 of the receiving coupling part 4. It is alternatively basically also possible for the insert coupling part 5 to be provided with only one insert guide portion 39.

In the preferred embodiment variant, the first insert guide portion 38 comprises an annular collar 40, which extends about a profile portion of the base body 32 of the insert coupling part 5. The annular collar 40 preferably surrounds the X-shaped profile of the base body 32 completely. The annular collar 40 runs parallel and spaced apart from the circular end wall 34.

In the assembly position shown in FIG. 1 and FIG. 2, the annular collar 40 is used to lock the insert coupling part 5 in the locking receiver 18 of the locking guide receiving portion 17 of the receiving coupling part 4 and to rotatably mount the insert coupling part 5 in the receiving coupling part 4. In the assembly position, the annular collar 40 engages in regions in the insert window 21 of the locking receiver 18. The outer radius of the annular collar 40 is to be selected such that this is slightly smaller than an internal diameter of the base body 7 of the receiving coupling part 4 in the region of the locking receiver 18. Since the locking receiver 18 extends about the connecting axis 6 in the peripheral direction through more than 180°, the locking receiver 18 consequently also extends in the assembly position through more than 180° about the annular collar 40. Owing to the guidance of the annular collar 40 in the locking receiver 18, a rotary movement of the insert coupling part 5 relative to the receiving coupling part 4 or a rotational movement of the receiving coupling part 4 relative to the insert coupling part 5 is possible.

In the assembly position, a movement of the insert coupling part 5 along the connecting axis 6 is preferably prevented inter alia by a movement of the annular collar 40 along the connecting axis 6 being blocked upwardly by the first end wall 9 and downwardly by the locking collar 20.

Since the locking receiver 18 extends through more than 180° in the peripheral direction about the connecting axis 6, it is not possible for the insert coupling part 5 to tilt in the assembly position out of the receiving coupling part 4 without additional action of force.

A peripheral groove 41, which is preferably arranged adjacent to the annular collar 40 in the direction of the end wall 34, is furthermore provided in the region of the first insert guide portion 38. In the assembly position according to FIG. 1 and FIG. 2, the peripheral groove 41 is arranged radially adjacent to the locking collar 20 of the locking guide receiving portion 17 of the receiving coupling part 4. The locking collar 20 preferably engages in the peripheral groove 41 and is used to guide the insert coupling part 5 in the receiving coupling part 4.

The end wall 34 of the insert coupling part 5 is guided in the second guide receiving portion 22 in the assembly position. For this purpose, the end wall inner side 37 engages, in the assembly position, under the counter-collar 26 and thus additionally secures the insert coupling part 5 against an axial movement upward along the connecting axis 6. The end wall outer side 36 of the insert coupling part 5 is arranged adjacent to the end wall inner side 16 in the assembly position. As a result, an axial movement of the insert coupling part is blocked downwardly along the connecting axis.

A second peripheral groove 42 in the form of an insert guide groove is then preferably provided on the end wall 34. In the embodiment variant shown, the counter-collar 26 engages in the insert guide groove 42 and thus improves the guidance of the second insert guide portion 39 of the insert coupling part 5 in the second guide receiving portion 22 of the receiving coupling part 4.

The first peripheral groove 41 and the second peripheral groove 42 are preferably formed between the end wall 34 and the annular collar 40 by a plurality of stop bulges 43. Four stop bulges 43 are preferably provided, which extend outwardly away from the X-shaped base body 32. The stop bulges 43 in each case run semi-circularly between the first peripheral groove 41 and the second peripheral groove 42, the lowest points of the stop bulges 43 being in each case located in the region of the first peripheral groove 41 and the second peripheral groove 42.

In the assembly position, at least one of the stop bulges 43 is arranged adjacent to the stop guide inner face 31 of the third guide receiving portion 30 of the receiving coupling part. At least one of the stop bulges 43 preferably rests in a sliding manner on the stop guide inner face 31.

The stop bulges 43 form a third insert guide portion 44, which extends along the centre longitudinal axis 33 between the first insert guide portion 38 and the second insert guide portion 39. The third insert guide portion 44 of the insert coupling part 5 interacts with the third guide receiving portion 30 of the receiving coupling part 4.

It is basically also possible to configure the insert coupling part 5 without the stop bulges 43. The provision of stop bulges 43 of this type, apart from a radial guidance of the insert coupling part 5 in the receiving coupling part 4, also, however, has the advantage that the insertion and release of the insert coupling part 5 is facilitated by the stop bulges 43.

The production of the connection between the receiving coupling part 4 and the insert coupling part 5 to form a coupling 1 will be described below with reference to FIGS. 1 to 6.

A coupling 1 to connect two toy components 2, 3 is to be provided by means of the coupling parts 4, 5. For this purpose, the insert coupling part 5 with its insert guide portions 38, 39 is firstly to be brought into the receiving region 12 of the receiving coupling part 4. The insert coupling part 5 is to be introduced obliquely for this purpose into the receiving region 12, with the free end in the form of the end wall 34 leading. When the end wall 34 of the insert coupling part 5 engages in regions in the counter-window 29, the annular collar 40 is to be brought into a locking connection with the locking guide receiving portion 17 by tilting the insert coupling part 5 relative to the receiving coupling part 4 about a tilting axis 45 perpendicular to the connecting axis 6. Since, during the tilting movement, the counter-collar 26 forms an abutment stop for the second insert guide portion 39, only a small expenditure of force is necessary to overcome the locking force or snap-on force. The locking of the first insert guide portion 38 into the locking receiver 18 is acoustically perceivable by a clicking noise which is caused by the snap-on motion. The coupling 1 is now in the assembly position according to FIG. 1 and FIG. 2.

If the coupling 1 is now to be released again, it is necessary to tilt the insert coupling part 5 again relative to the receiving coupling part 4 about the tilting axis 45 perpendicular to the connecting axis 6. To release the insert coupling part 5, it is necessary to overcome the locking force again. The necessary expenditure of force is significantly reduced by a second abutment stop in the form of the stop guide inner face 31. At least one of the stop bulges 43 is used as the abutment. After overcoming the locking force, the insert coupling part is to be guided again obliquely out of the receiving region 12 of the receiving coupling part 4. The coupling is now in the disassembly position again.

What is claimed is:

1. A coupling for connecting two toy components, the coupling comprising:

a first coupling part connected to one of the two toy components a second coupling part connected to the other of the two toy components, wherein the two coupling parts, are connected to one another along a connecting axis such that said two coupling parts are rotatable relative to one another about said connecting axis, wherein one of the coupling parts comprises a receiving coupling part and said receiving coupling part comprises at least one locking guide receiving portion, said at least one locking guide receiving portion having a locking receiver extending in a peripheral direction about the connecting axis through more than 180°, wherein the other of the coupling parts comprises an insert coupling part and said insert coupling part has at least two insert guide portions, said insert guide portions being axially spaced apart from one another along the connecting axis and said insert guide portions being guided radially in the receiving coupling part, at least said at least one locking guide receiving portion generating a snap in retaining function as at least one of said insert guide portions is inserted in said receiving coupling part, wherein a first insert guide portion is simultaneously a counter-locking portion, which is received so as to lock in the locking guide receiving portion of the receiving coupling part, wherein a second insert guide portion is provided, which is guided in a second guide receiving portion of the receiving coupling part.

2. A coupling according to claim 1, wherein the second insert guide portion has an insert guide groove, which is guided by the second guide receiving portion in the form of a counter-collar (26).

3. A coupling according to claim 1, wherein at least one of the two coupling parts is connected in one piece to the associated toy component.

4. A coupling according to claim 3, wherein the one-piece connection is a one-piece injection molded component connecting piece to one of a crane shovel and a wood loading gripper.

5. A coupling according to claim 4, wherein said one-piece injection molded component is a crane hook.

6. A coupling according to claim 1, wherein one of the insert guide portions is radially guided in the locking guide receiving portion.

7. A coupling according to claim 1, wherein the locking guide receiving portion comprises a part connecting sleeve, the locking receiver having an insert window, which extends in the peripheral direction about the connecting axis through less than 180°, to insert the insert coupling part in the receiving coupling part.

8. A coupling according to claim 1, wherein at least one of the insert guide portions has an annular collar around a base body of the insert coupling part.

9. A coupling according to claim 1, wherein at least one of the insert guide portions is axially guided in the receiving coupling part.

10. A coupling according to claim 1, wherein one of the insert guide portions is axially guided in the locking guide receiving portion, one of the insert guide portions having a peripheral groove in a region of the locking receiver.

11. A coupling according to claim 1, wherein the receiving coupling part has a first abutment stop for insertion of the insert coupling part in the receiving coupling part by overcoming the locking force.

12. A coupling according to claim 1, wherein the receiving coupling part has a second abutment stop to release the insert coupling part from the receiving coupling part by overcoming the locking force.

13. A coupling according to claim 1, wherein the insert coupling part is one or more of inserted and released by tilting the insert coupling part relative to the receiving coupling part about a tilting axis perpendicular to the connecting axis, wherein a counter-window is provided in the receiving coupling part (4) to facilitate the insertion.

14. A toy with a coupling for connecting two toy components, the toy comprising:

a first coupling part connected to one of the two toy components a second coupling part connected to the other of the two toy components, wherein the two coupling parts, are connected to one another along a connecting axis such that said two coupling parts are rotatable relative to one another about said connecting axis, wherein one of the coupling parts comprises a receiving coupling part and said receiving coupling part comprises at least one locking guide receiving portion, said at least one locking guide receiving portion comprising a locking receiver extending in a peripheral direction about the connecting axis through more than 180°, wherein the other of the coupling parts comprises an insert coupling part and said insert coupling comprises at least two insert guide portions, said at least two insert guide portions being axially spaced apart from one another along the connecting axis and said at least two insert guide portions being guided radially in the receiving coupling part, at least said at least one locking guide receiving portion generating a snap in retaining function as at least one of said insert guide portions is inserted in said receiving coupling part, wherein a first insert guide portion is simultaneously a counter-locking portion, which is received so as to lock in the locking guide receiving portion of the receiving coupling part, wherein a second insert guide portion is provided, which is guided in a second guide receiving portion of the receiving coupling part, wherein the toy is one of a crane and a toy vehicle.

15. A toy according to claim 14, wherein the toy is one of a loader, logging skidder, a logging trailer and a forest tractor.

16. A coupling for connecting two toy components, the coupling comprising:

a receiving coupling part connected to one of the two toy components, said receiving coupling part comprising a first inserting guide portion retaining portion and a second inserting guide portion retaining portion, said first inserting guide portion retaining portion defining at least a portion of a first retaining portion space, said second inserting guide portion retaining portion defining at least a portion of a second retaining portion space;

an inserting coupling part connected to another one of the two toy components, said insert coupling part comprising a first inserting coupling guide portion and a second inserting coupling guide portion, said first inserting coupling guide portion being located at an axially spaced location from said second inserting coupling guide portion with respect to a longitudinal axis of said inserting coupling part, said first inserting guide portion retaining portion generating a first snap in retaining function as said first inserting coupling guide portion is inserted in said first retaining portion space, said second inserting guide portion retaining portion generating a second snap in retaining function as said second inserting coupling guide portion is inserted in said second retaining space, wherein said receiving coupling part is connected to said inserting coupling part such that said receiving coupling part and said inserting coupling part are rotatable relative to one another about said longitudinal axis.

17. A coupling according to claim 16, wherein said first inserting guide portion retaining portion comprises a locking receiver extending more than 180° in a peripheral direction about the longitudinal axis, said first inserting coupling guide portion comprising a first end portion and a second end portion, said first end portion being located at a spaced location from said second end portion with respect to said peripheral direction.

18. A coupling according to claim 17, wherein said second inserting guide portion retaining portion comprises a first retaining end portion and a second retaining end portion, said first retaining end portion being located at a spaced location from said second retaining end portion with respect to said peripheral direction.

19. A coupling according to claim 18, wherein said first inserting guide portion retaining portion is located at an axially spaced location from said second inserting guide portion retaining portion with respect to said longitudinal axis.

20. A coupling according to claim 19, wherein said inserting coupling part comprises a stop bulge located between said first inserting coupling guide portion and said second inserting coupling guide portion, said receiving coupling part comprising a third inserting guide portion retaining portion, said third inserting guide portion retaining portion defining at least a portion of an annular space, said third inserting guide portion retaining portion generating a third snap in retaining function as said stop bulge is inserted in said annular space.

* * * * *